US011453838B2

(12) United States Patent
Wong et al.

(10) Patent No.: US 11,453,838 B2
(45) Date of Patent: Sep. 27, 2022

(54) WAX-CONTAINING, ORGANIC THICKENED LUBRICANT POWDER

(71) Applicants: EXXONMOBIL TECHNOLOGY AND ENGINEERING COMPANY, Annandale, NJ (US); MaryJo Baum, Milford, NJ (US)

(72) Inventors: Flory K. Wong, Morristown, NJ (US); Mark W. Baum, Milford, NJ (US)

(73) Assignee: EXXONMOBIL TECHNOLOGY AND ENGINEERING COMPANY, Annandale, NJ (US)

( * ) Notice: Subject to any disclaimer, the term of this patent is extended or adjusted under 35 U.S.C. 154(b) by 0 days.

(21) Appl. No.: 17/446,313

(22) Filed: Aug. 30, 2021

(65) Prior Publication Data

US 2022/0073838 A1 Mar. 10, 2022

Related U.S. Application Data

(60) Provisional application No. 63/075,777, filed on Sep. 8, 2020.

(51) Int. Cl.

| | |
|---|---|
| ***C10L 1/16*** | (2006.01) |
| ***C10M 169/02*** | (2006.01) |
| ***C10M 107/02*** | (2006.01) |
| ***C10M 119/14*** | (2006.01) |
| ***C10M 169/06*** | (2006.01) |
| *C10N 20/02* | (2006.01) |
| *C10N 40/02* | (2006.01) |
| *C10N 30/06* | (2006.01) |

(Continued)

(52) U.S. Cl.

CPC ..... *C10M 169/02* (2013.01); *C10M 107/02* (2013.01); *C10M 119/14* (2013.01); *C10M 169/06* (2013.01); *C10M 2205/163* (2013.01); *C10M 2217/0456* (2013.01); *C10N 2020/02* (2013.01); *C10N 2030/06* (2013.01); *C10N 2030/08* (2013.01); *C10N 2040/02* (2013.01); *C10N 2050/08* (2013.01); *C10N 2050/10* (2013.01)

(58) Field of Classification Search

CPC ..... C10M 169/02; C10M 107/02; C10M 119/14; C10M 169/06; C10M 2205/163; C10M 2217/0456; C10N 2020/02; C10N 2030/06; C10N 2030/08; C10N 2040/02; C10N 2050/08; C10N 2050/10

USPC ..... 508/591

See application file for complete search history.

(56) References Cited

U.S. PATENT DOCUMENTS 6,465,398 B1 * 10/2002 Arnold ..... C09G 3/00 280/610
2008/0242568 A1 10/2008 Poirier
2018/0298305 A1 * 10/2018 Thomas ..... C10M 171/06

OTHER PUBLICATIONS

B.C. Poon et al., "Adhesion of Polyethylene Blends To Polypropylene", Elsevier Ltd., Sep. 3, 2003, The Dow Chemical Company, Polymer 45 (2004) pp. 893-903.

* cited by examiner

*Primary Examiner* — Prem C Singh
*Assistant Examiner* — Francis C Campanell
(74) *Attorney, Agent, or Firm* — Vorys, Sater, Seymour and Pease LLP

(57) ABSTRACT

This disclosure relates to a lubricant powder composition that is made from a combination of wax, grease thickener, and additives. The lubricant powder composition exhibits low frictional, and improved mechanical stability in high temperature environments. This disclosure further relates to the use of a lubricant powder composition in a mechanical component.

14 Claims, 6 Drawing Sheets

(51) Int. Cl.

| | |
|---|---|
| *C10N 30/08* | (2006.01) |
| *C10N 50/08* | (2006.01) |
| *C10N 50/10* | (2006.01) |

WAX-CONTAINING, ORGANIC THICKENED LUBRICANT POWDER

CROSS-REFERENCE TO RELATED APPLICATIONS

This application claims the benefit of U.S. Provisional Application No. 63/075,777, filed on Sep. 8, 2020, the entire contents of which are incorporated herein by reference.

FIELD OF THE INVENTION

This disclosure relates generally to lubricating compositions and methods of making and using the same. More specifically, the present disclosure relates to lubricant powder compositions that are made from a combination of wax, grease thickener, and additives. The lubricant powder compositions exhibit low frictional, and improved mechanical stability in high temperature environments. The lubricant powder compositions provide optimum performance in a wide variety of diverse industrial and automotive applications.

BACKGROUND

Liquid lubricants and greases with a wide assortment of different materials are known. Current state of the art liquid lubricants and greases all utilize base oils as the basis of the lubricant, with additives blended in to impart additional properties, e.g. antioxidancy, rust protection. For example, polyurea greases and lithium complex greases are known and can be made from any of a wide variety of base stocks of lubricating oil viscosity, as well as mixtures of base stocks. Greases have varied levels of desirable grease characteristics, such as dropping point, penetration, mechanical stability, shear stability, oxidation resistance, high temperature resistance, etc., based on their compositions.

While most greases provide improved frictional benefits and wear protection for mechanical systems, they have a tendency to move away from contact surfaces due to shear thinning and oil leakage. Such undesirable behaviors can lead to lubricant starved regimes, which makes the lubricant ineffective.

Solid and powder lubricants have a lower tendency to migrate in comparison to liquid lubricants and greases, but they are not without shortcomings. Often, these materials have poor adhesive properties to the system surfaces and slowly migrate from contact surfaces under load. Solid and powder lubricants also have the limitation of retaining heat in the systems used, often acting as an insulating material. The limited number of solid and powder lubricants present on the market have illustrated that these products have room for improvement, especially for ball bearing lubrication.

Thus, a need exists for lubricating powder compositions that have low frictional properties, and improved mechanical stability in high temperature environments, which can be used to replace traditional liquid lubricants and greases.

SUMMARY

This disclosure relates generally to lubricating compositions and methods of making and using the same. More specifically, the present disclosure relates to lubricant powder compositions that are made from a combination of wax, grease thickener (e.g., polyurea powder), and additives. The lubricant powder compositions exhibit low frictional properties, and improved mechanical stability in high temperature environments. The lubricant powder compositions provide optimum performance in a wide variety of diverse industrial and automotive applications.

This disclosure also relates in part to a lubricant powder composition having at least one wax, at least one organic thickener, and at least one additives. The type of wax is not limited, and can be selected from natural waxes (e.g., plant and animal waxes), modified natural waxes, and/or synthetic waxes (e.g., paraffin waxes and polyethylene and related derivatives waxes).

In one aspect, the lubricant powder composition of this disclosure includes a wax, a grease thickener, and an additive; wherein the wax is in an amount of about 50 wt. % or higher in the lubricant powder composition, and the lubricant powder composition is solid at room temperature or a temperature of 35° C. or lower.

In some embodiments, the grease thickener is an organic grease thickener or an inorganic grease thickener. In some specific embodiments, the organic thickener is a polyurea powder.

When a lubricant powder composition of this disclosure is used, it exceeds the performance of conventional lithium complex greases in the ASTM D3336 High temperature ball bearing test for grease, operating at 350° F. (177° C.) at 10,000 rpm. The lubricant powder composition passes a modified rust test ASTM D1743, static rust test, and it exhibits low frictional properties in the ASTM D5707 SRV wear test.

This disclosure further relates in part to a mechanical component lubricated with the lubricant powder composition of this disclosure.

It has been surprisingly found that, the lubricant powder composition of this disclosure is adhesive to the metal surface, and is suitable for bearings exposed to high temperatures where conventional lubricants typically migrate or bleed from the system.

Other objects and advantages of the present disclosure will become apparent from the detailed description that follows.

DETAILED DESCRIPTION

Figure 1:
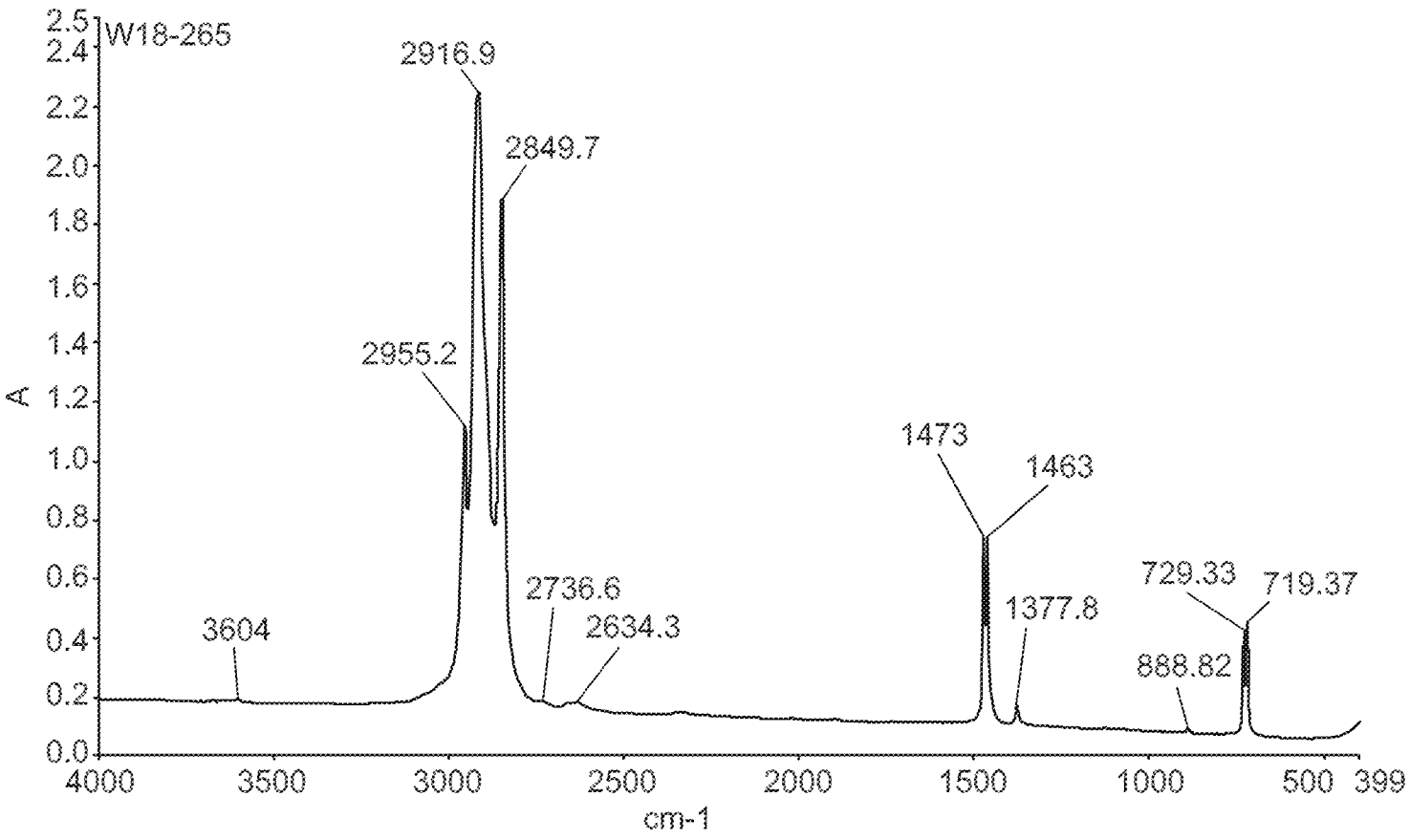
FIG. 1 illustrates a Fourier-transform infrared (FTIR) spectroscopy of a wax used in an exemplary lubricant powder composition of the present disclosure.

All numerical values within the detailed description and the claims herein are modified by "about" or "approximately" the indicated value, and take into account experimental error and variations that would be expected by a person having ordinary skill in the art. The phrase "major amount" as it relates to components included within the lubricant powder composition of the specification and the claims means greater than or equal to 50 wt. %, or greater than or equal to 60 wt. %, or greater than or equal to 70 wt. %, or greater than or equal to 80 wt. %, or greater than or equal to 90 wt. % based on the total weight of the lubricant powder composition. The phrase "minor amount" as it relates to components included within the lubricant powder composition of the specification and the claims means less than 50 wt. %, or less than or equal to 40 wt. %, or less than or equal to 30 wt. %, or greater than or equal to 20 wt. %, or less than or equal to 10 wt. %, or less than or equal to 5 wt. %, or less than or equal to 2 wt. %, or less than or equal to 1 wt. %, based on the total weight of the lubricant powder composition.

The lubricant powder compositions of this disclosure relate in part to lubricant powder compositions containing at least one wax in a major amount. The type of the wax is not limited, and can be selected from natural waxes (e.g., plant and animal waxes), modified natural waxes, and/or synthetic waxes (e.g., paraffin waxes and polyethylene and related derivatives waxes). The amount of wax is not limited, and can be in an amount of about 50 wt. % or higher in the lubricant powder composition. In certain embodiments, the amount of wax is about 55 wt. % or higher, about 60 wt. % or higher, about 65 wt. % or higher, about 70 wt. % or higher, about 75 wt. % or higher, or about 80 wt. % or higher in the lubricant powder composition.

In addition to the wax, the lubricant powder compositions of this disclosure also contain one or more grease thickeners in a minor amount. The type of grease thickeners is not limited, and can be selected from organic or inorganic thickeners. The amount of grease thickeners is not limited, and can be in an amount of about 50 wt. % or less in the lubricant powder composition. In certain embodiments, the amount of grease thickeners is about 45 wt. % or less, about 40 wt. % or less, about 35 wt. % or less, about 30 wt. % or less, about 25 wt. % or less, about 20 wt. % or less, or about 15 wt. % or less in the lubricant powder composition.

In addition to the wax and the grease thickener, the lubricant powder compositions of this disclosure may also contain one or more additives in a minor amount. The type of additives is not limited, and can be selected from a group of an anticorrosive agent or corrosion inhibitor, an extreme pressure additive, an antiwear agent, a pour point depressants, an antioxidant or oxidation inhibitor, a rust inhibitor, a metal deactivator, a dispersant, a demulsifier, a dye or colorant/chromophoric agent, a seal compatibility agent, a friction modifier, a viscosity modifier/improver, a viscosity index improver, or combinations thereof. The amount of the additive is not limited, and can be in an amount of about 20 wt. % or less in the lubricant powder composition. In certain embodiments, the amount of additives is about 17.5 wt. % or less, about 15 wt. % or less, about 12.5 wt. % or less, about 10 wt. % or less, about 7.5 wt. % or less, about 5 wt. % or less, or about 2.5 wt. % or less in the lubricant powder composition.

In one aspect, the lubricant powder composition of this disclosure comprising: a wax, a grease thickener, and an additive; wherein the wax is in an amount of about 50 wt. % or higher in the lubricant powder composition, and the lubricant powder composition is solid at a temperature of 35° C. or at a temperature lower than 35° C. In certain embodiments, the wax is a natural wax or a synthetic wax with a melting point of about 37° C. or higher. In certain embodiment, the grease thickener is an organic thickener or an inorganic thickener.

In certain embodiments, the lubricant powder composition of this disclosure comprising one or more waxes in an amount of about 50 wt. % to about 90 wt. %, one or more grease thickeners in an amount of about 5 wt. % to about 40 wt. %, and one or more additives in an amount of about 0.1 wt. % to about 10 wt. %, in the lubricant powder composition. In certain embodiments, the lubricant powder composition of this disclosure comprising one or more waxes in an amount of about 60 wt. % to about 80 wt. %, one or more grease thickeners in an amount of 10 wt. % to about 30 wt. %, and one or more additives in an amount of about 3 wt. % to about 10 wt. %, in the lubricant powder composition. In certain embodiments, the lubricant powder composition of this disclosure comprising one or more waxes in an amount of about 70 wt. % to about 80 wt. %, one or more grease thickeners in an amount of about 10 wt. % to about 30 wt. %, and one or more additives in an amount of about 5 wt. % to about 10 wt. %, in the lubricant powder composition.

The lubricant powder compositions of this disclosure can be used in automobiles, diesel engines, axles, transmissions, and industrial applications. The lubricant powder compositions must meet the specifications for their intended application as defined by the concerned governing organization. In particular, the lubricant powder compositions of this disclosure provide optimum performance in a wide variety of diverse industrial and automotive applications. For example: sealed for life applications, electric motors, automotive wheel bearings, paper machine roll bearings (wet and dry), and wind turbines require different degrees of structural stability and oil release rates, responding to mechanical and thermal stress.

Wax

Waxes are a diverse class of organic compounds that are lipophilic, malleable solids near ambient temperatures. They include higher alkanes and lipids, typically with melting points above about 40° C. (104° F.), melting to give low viscosity liquids. Waxes are insoluble in water but soluble in organic, nonpolar solvents. Natural waxes may contain unsaturated bonds and include various functional groups such as fatty acids, primary and secondary alcohols, ketones, aldehydes and fatty acid esters, and aromatic compounds may also be present. Synthetic waxes often consist of homologous series of long-chain aliphatic hydrocarbons (alkanes or paraffins) that lack functional groups.

Illustrative wax include, for example, natural waxes (e.g., plant and animal waxes), modified natural waxes, and/or synthetic waxes (e.g., paraffin waxes and polyethylene and related derivatives waxes).

Illustrative animal wax is beeswax used in constructing the honeycombs of honeybees, but other insects secrete waxes. A major component of the beeswax is myricyl palmitate which is an ester of triacontanol and palmitic acid. Its melting point is 62-65° C. Illustrative plant wax is carnauba wax, a hard wax obtained from the Brazilian palm

*Copernicia prunifera*. Plant and animal based waxes or oils can also undergo selective chemical modifications, which are known in the art, to produce waxes with improved properties.

Illustrative paraffin wax is a soft colorless solid, derived from petroleum, coal or shale oil, which consists of a mixture of hydrocarbon molecules containing between twenty and forty carbon atoms with a typical melting point between about 46 and 68° C.

Illustrative polyethylene and related derivatives waxes are low molecular weight polyethylene polymers, which are produced by manufactured by one of three methods: 1—direct polymerization of ethylene (may include co-monomers also); 2—thermal degradation of high molecular weight polyethylene resin; 3—recovery of low molecular weight fractions from high molecular weight resin production.

The lubricant powder composition of this disclosure may include a wax in a range from about 50 to about 90 wt. %. For example, the lubricant powder composition of the present disclosure may have wax present in an amount of about 50 wt. % to about 85 wt. %, about 50 wt. % to about 80 wt. %, about 50 wt. % to about 75 wt. %, about 50 wt. % to about 70 wt. %, about 50 wt. % to about 65 wt. %, about 50 wt. % to about 60 wt. %, about 60 wt. % to about 90 wt. %, about 60 wt. % to about 85 wt. %, about 60 wt. % to about 80 wt. %, about 60 wt. % to about 75 wt. %, about 60 wt. % to about 70 wt. %, about 60 wt. % to about 65 wt. %, about 65 wt. % to about 90 wt. %, about 65 wt. % to about 85 wt. %, about 65 wt. % to about 80 wt. %, about 65 wt. % to about 75 wt. %, about 65 wt. % to about 70 wt. %, about 70 wt. % to about 90 wt. %, about 70 wt. % to about 85 wt. %, about 70 wt. % to about 80 wt. %, about 70 wt. % to about 75 wt. %, about 75 wt. % to about 90 wt. %, about 75 wt. % to about 85 wt. %, about 75 wt. % to about 80 wt. %, about 80 wt. % to about 90 wt. %, about 80 wt. % to about 85 wt. %, or about 85 wt. % to about 90 wt. %, of the total weight of the lubricant powder composition.

Grease Thickeners

The grease thickener of the present disclosure is not limited, and can be selected from an organic thickener or an inorganic thickener, or a combination of both.

The organic thickener of the present disclosure is not limited, and can be selected from a soap thickener or a polyurea thickeners. Polyurea thickeners are compounds containing the urea group (—NHCONH—) in their molecular structure. These compounds include mono-, di-, tri-, tetra- and polyurea compounds, depending upon the number of urea linkages they contain. Polyurea is the preferred thickener for use in the compositions of this disclosure.

A lubricant powder composition according to this disclosure may contain more than one organic thickener.

In an embodiment, the lubricant powder compositions of this disclosure having an organic thickener exhibit improved structural stability and resistance to breaking down and losing their consistency under the effect of high temperature conditions.

The lubricant powder compositions of this disclosure may include an organic thickener (e.g., a polyurea thickener) in a range from about 0.5 to about 40 wt. % (e.g., about 5 to about 25 wt. %). For example, the lubricant powder composition of the present disclosure may have at least one organic thickener present in an amount of about 0.5 wt. % to about 30 wt. %, about 0.5 wt. % to about 25 wt. %, about 0.5 wt. % to about 20 wt. %, about 0.5 wt. % to about 15 wt. %, about 0.5 wt. % to about 10 wt. %, about 0.5 wt. % to about 5 wt. %, about 1 wt. % to about 40 wt. %, about 1 wt. % to about 30 wt. %, about 1 wt. % to about 25 wt. %, about 1 wt. % to about 20 wt. %, about 1 wt. % to about 15 wt. %, about 1 wt. % to about 10 wt. %, about 1 wt. % to about 5 wt. %, about 2.5 wt. % to about 30 wt. %, about 2.5 wt. % to about 25 wt. %, about 2.5 wt. % to about 20 wt. %, about 2.5 wt. % to about 15 wt. %, about 2.5 wt. % to about 10 wt. %, about 2.5 wt. % to about 5 wt. %, about 5 wt. % to about 40 wt. %, about 5 wt. % to about 30 wt. %, about 5 wt. % to about 25 wt. %, about 5 wt. % to about 20 wt. %, about 5 wt. % to about 15 wt. %, about 5 wt. % to about 10 wt. %, about 7.5 wt. % to about 40 wt. %, about 7.5 wt. % to about 30 wt. %, about 7.5 wt. % to about 25 wt. %, about 7.5 wt. % to about 20 wt. %, about 10 wt. % to about 40 wt. %, about 10 wt. % to about 30 wt. %, about 10 wt. % to about 20 wt. %, about 15 wt. % to about 40 wt. %, about 15 wt. % to about 30 wt. %, about 15 wt. % to about 20 wt. %, about 20 wt. % to about 40 wt. %, about 20 wt. % to about 30 wt. %, or about 20 wt. % to about 20 wt. %, based on the total weight of the lubricant powder composition.

The inorganic thickener of the present disclosure is not limited, and can be selected from talc, graphite, and Group I, II and IV metal oxides such as zinc, titanium and magnesium oxides, and carbonates, such as calcium carbonate, sodium carbonate, e.g., Na CO Na CO-r HO, zinc carbonate, e.g., ZnCO ZnCO—HO, and magnesium carbonate etc.

A lubricant powder composition according to this disclosure may contain more than one inorganic thickener.

In an embodiment, the lubricant powder compositions of this disclosure having an inorganic thickener exhibit improved structural stability and resistance to breaking down and losing their consistency under the effect of high temperature conditions.

The lubricant powder compositions of this disclosure may include at least one inorganic thickener in a range from about 0.5 to about 40 wt. % (e.g., about 5 to about 25 wt. %). For example, the lubricant powder composition of the present disclosure may have an inorganic thickener present in an amount of about 0.5 wt. % to about 30 wt. %, about 0.5 wt. % to about 25 wt. %, about 0.5 wt. % to about 20 wt. %, about 0.5 wt. % to about 15 wt. %, about 0.5 wt. % to about 10 wt. %, about 0.5 wt. % to about 5 wt. %, about 1 wt. % to about 40 wt. %, about 1 wt. % to about 30 wt. %, about 1 wt. % to about 25 wt. %, about 1 wt. % to about 20 wt. %, about 1 wt. % to about 15 wt. %, about 1 wt. % to about 10 wt. %, about 1 wt. % to about 5 wt. %, about 2.5 wt. % to about 30 wt. %, about 2.5 wt. % to about 25 wt. %, about 2.5 wt. % to about 20 wt. %, about 2.5 wt. % to about 15 wt. %, about 2.5 wt. % to about 10 wt. %, about 2.5 wt. % to about 5 wt. %, about 5 wt. % to about 40 wt. %, about 5 wt. % to about 30 wt. %, about 5 wt. % to about 25 wt. %, about 5 wt. % to about 20 wt. %, about 5 wt. % to about 15 wt. %, about 5 wt. % to about 10 wt. %, about 7.5 wt. % to about 40 wt. %, about 7.5 wt. % to about 30 wt. %, about 7.5 wt. % to about 25 wt. %, about 7.5 wt. % to about 20 wt. %, about 10 wt. % to about 40 wt. %, about 10 wt. % to about 30 wt. %, about 10 wt. % to about 20 wt. %, about 15 wt. % to about 40 wt. %, about 15 wt. % to about 30 wt. %, about 15 wt. % to about 20 wt. %, about 20 wt. % to about 40 wt. %, about 20 wt. % to about 30 wt. %, or about 20 wt. % to about 20 wt. %, based on the total weight of the lubricant powder composition.

Performance Additives

The composition of the present disclosure may include small amounts of at least one (e.g., 1, 2, 3, 4, 5, or 6, or more) performance additive. For example, the composition of the present disclosure may include at least one of anticorrosive agent or corrosion inhibitor, an extreme pressure additive, an antiwear agent, a pour point depressants, an antioxidant or oxidation inhibitor, a rust inhibitor, a metal deactivator, a dispersant, a demulsifier, a dye or colorant/chromophoric agent, a seal compatibility agent, a friction modifier, a viscosity modifier/improver, a viscosity index improver, or combinations thereof. In addition, other solid lubricants such as molybdenum disulfide and graphite may be present in the composition of the present disclosure, such as from about 1 to about 5 wt. % (e.g., from about 1.5 to about 3 wt. %) for molybdenum disulfide and from about 3 to about 15. wt. % (e.g., from about 6 to about 12 wt. %) for graphite.

The amounts of individual additives will vary according to the additive and the level of functionality to be provided by it.

The presence or absence of these lubricating oil performance additives does not adversely affect the compositions of the present disclosure. For a review of many commonly used additives, see Klamann in Lubricants and Related Products, Verlag Chemie, Deerfield Beach, Fla.; ISBN 0 89573 177 0. Reference is also made to "Lubricant Additives" by M. W. Ranney, published by Noyes Data Corporation of Parkridge, N.J. (1973) and "Lubricant Additives: Chemistry and Applications" edited by L. R. Rudnick, published by CRC Press of Boca Raton, Fla. (2009). Specific examples of different performance additives may also be found, for example, in US20080242568A1. All these references are incorporated herein. The performance additives useful in the present disclosure do not have to be soluble in the lubricating oils. Insoluble additives in oil can be dispersed in the lubricating oils of the present disclosure. The types and quantities of performance additives used in combination with the compositions of the present disclosure are not limited by the examples shown herein as illustrations.

As such, in any aspect or embodiment described herein, the composition further comprises at least one of anticorrosive agent or corrosion inhibitor, an extreme pressure additive, an antiwear agent, a pour point depressants, an antioxidant or oxidation inhibitor, a rust inhibitor, a metal deactivator, a dispersant, a demulsifier, a dye or colorant/chromophoric agent, a seal compatibility agent, a friction modifier, a viscosity modifier/improver, a viscosity index improver, or combinations thereof. In any aspect or embodiment described herein, the dispersant includes succinimide-type dispersant. Unless specified otherwise, the performance additive or performance additives listed above are present in a total amount equal to or less than about 10 wt. %, equal to or less than about 9.5 wt. %, equal to or less than about 9 wt. %, equal to or less than about 8.5 wt. %, equal to or less than about 8 wt. %, equal to or less than about 7.5 wt. %, equal to or less than about 7 wt. %, equal to or less than about 6.5 wt. %, equal to or less than about 6 wt. %, equal to or less than about 5.5 wt. %, equal to or less than about 5 wt. %, equal to or less than about 4.5 wt. %, equal to or less than about 4 wt. %, equal to or less than about 3.5 wt. %, equal to or less than about 3 wt. %, equal to or less than about 2.5 wt. %, equal to or less than about 2 wt. %, equal to or less than about 1.5 wt. %, or equal to or less than about 0.5 wt. %. For example, the performance additive or performance additives are present in a total amount of about 0.1 to about 10 wt. %, about 0.1 to about 9 wt. %, about 0.1 to about 8 wt. %, about 0.1 to about 7 wt. %, about 0.1 to about 6 wt. %, about 0.1 to about 5 wt. %, about 0.1 to about 4 wt. %, about 0.1 to about 3 wt. %, about 0.1 to about 2 wt. %, about 0.1 to about 1 wt. %, about 0.5 to about 10 wt. %, about 0.5 to about 9 wt. %, about 0.5 to about 8 wt. %, about 0.5 to about 7 wt. %, about 0.5 to about 6 wt. %, about 0.5 to about 5 wt. %, about 0.5 to about 4 wt. %, about 0.5 to about 3 wt. %, about 0.5 to about 2 wt. %, about 1 to about 10 wt. %, about 1 to about 9 wt. %, about 1 to about 8 wt. %, about 1 to about 7 wt. %, about 1 to about 6 wt. %, about 1 to about 5 wt. %, about 1 to about 4 wt. %, about 1 to about 3 wt. %, about 2 to about 10 wt. %, about 2 to about 9 wt. %, about 2 to about 8 wt. %, about 2 to about 7 wt. %, about 2 to about 6 wt. %, about 2 to about 5 wt. %, about 2 to about 4 wt. %, about 3 to about 10 wt. %, about 3 to about 9 wt. %, about 3 to about 8 wt. %, about 3 to about 7 wt. %, about 3 to about 6 wt. %, about 3 to about 5 wt. %, about 4 to about 10 wt. %, about 4 to about 9 wt. %, about 4 to about 8 wt. %, about 4 to about 7 wt. %, about 4 to about 6 wt. %, about 5 to about 10 wt. %, about 5 to about 9 wt. %, about 5 to about 8 wt. %, about 5 to about 7 wt. %, about 6 to about 10 wt. %, about 6 to about 9 wt. %, about 6 to about 8 wt. %, about 7 to about 10 wt. %, about 7 to about 9 wt. %, or about 8 to about 10 wt. %.

When the additives are described below by reference to individual components used in the formulation, they will not necessarily be present or identifiable as discrete entities in the final product but may be present as reaction products that are formed during the lubricant powder composition manufacture or even its use. This will depend on the respective chemistries of the ingredients, their stoichiometry, and the temperatures encountered in the lubricant powder composition making process or during its use. It will also depend, naturally enough, on whether or not the species are added as a pre-reacted additive package. For example, the acid amine phosphates may be added as discrete amines and acid phosphates but these may react to form a new entity in the final lubricant powder composition under the processing conditions used in the lubricant powder composition manufacture.

When the lubricant powder composition of the present disclosure includes one or more of the additives discussed herein, the additive(s) are blended into the composition in an amount sufficient for it to perform its intended function.

The lubricant powder composition can be mixed, blended, or milled in any number of ways including external mixers, roll mills, internal mixers, Banbury mixers, screw extruders, augers, colloid mills, homogenizers, and the like.

The present disclosure is further illustrated by the following examples, which should not be construed as limiting. The data below demonstrates that the compositions of the present disclosure provide the surprising and unexpected effect of having significantly improved structural stability and resistance to breaking down, relative to other greases, under high temperature conditions. Those skilled in the art will recognize that the disclosure may be practiced with variations on the disclosed structures, materials, compositions and methods, and such variations are regarded as within the ambit of the disclosure.

EXAMPLES

Lubricant powder compositions were prepared as described herein. All of the ingredients used herein are commercially available.

Evaluation of Wax Used in the Lubricant Powder Composition Formulation

Wax used in the present disclosure is characterized using conventional methods, and the result is listed in Table 1. The FTIR, FIG. 1, confirms that the wax is consistent with what is observed for petroleum paraffinic waxes. The sample was analysed by FTIR spectroscopy using the thin film on KBr method.

TABLE 1

Characterization of a sample wax.

| Property | Test Method | Result |
|---|---|---|
| Congealing point | ASTM D938 [° C.] | 59.8 |
| Needle penetration at 25° C. | ASTM D1321 [dmm] | 12 |
| Needle penetration at 40° C. | ASTM D1321 [dmm] | 44 |
| Colour | ASTM | <1.5 |
| Oil Content | ASTM D721 [wt %] | 0.2 |
| Kinematic Viscosity at 100° C. | ASTM D445 [cSt] | 4.5 |
| S and N | CHNS elemental analysis | Not detected |

Lubricant Powder Composition/Formulation

The lubricant powder compositions can have varying amounts of wax, thickener and additives. Wax, which has been used as an additive, is present in a major amount, e.g., higher than 50%. In this formulation, the wax is used as the basis of the lubricant, rather than as an additive. One illustrative example is presented in Table 2. The formulation of the lubricant is not limited to the additives listed in Table 2, with alterative additives that show similar performance.

TABLE 2

Exemplary lubricant powder composition

| Weight % | Component |
|---|---|
| 50-90% | Wax (see Table 1 for properties) |
| 3-20% | Thickener |
| 0.5-10% | Antioxidant additive |
| 0.5-10% | Antiwear and/or EP additive |
| 0.5-2% | Rust Inhibitor additive |

Figure 2:
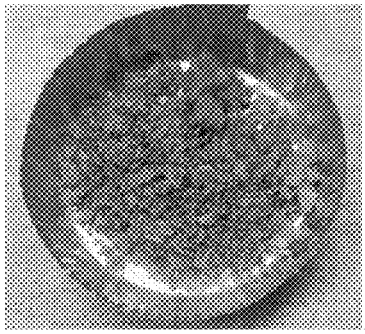
FIG. 2 illustrates a lubricant powder composition used to create a powder-like materials.

FIG. 2 illustrated that lubricant powder composition used to create a powder-like materials. The additives used in the lubricant powder compositions included conventional additives in conventional amounts. Conventional additives used in the formulations were one or more of an anticorrosive agent or corrosion inhibitor, an extreme pressure additive, an antiwear agent, a pour point depressants, an antioxidant or oxidation inhibitor, a rust inhibitor, a metal deactivator, a dispersant, a demulsifier, a dye or colorant/chromophoric agent, a seal compatibility agent, a friction modifier, a viscosity modifier/improver, and a viscosity index improver, as disclosed herein.

Performance of the lubricant powder compositions have been assessed to establish that the presence of all these components are necessary to achieve the lubricant performance. The integrity of the composition was examined to determine whether separation of components occurred at high temperatures. This often occurs in greases, where high temperatures causes the oil to bleed out over time. A sample of the powder was placed in a test tube and heated to 160° C. Unexpectedly, the melted lubricant powder compositions clung to the surface of the test tube and no separation of components were observed. This demonstrates that the formulation has both cohesive and adhesive properties desired in lubricants and greases.

Figure 3:
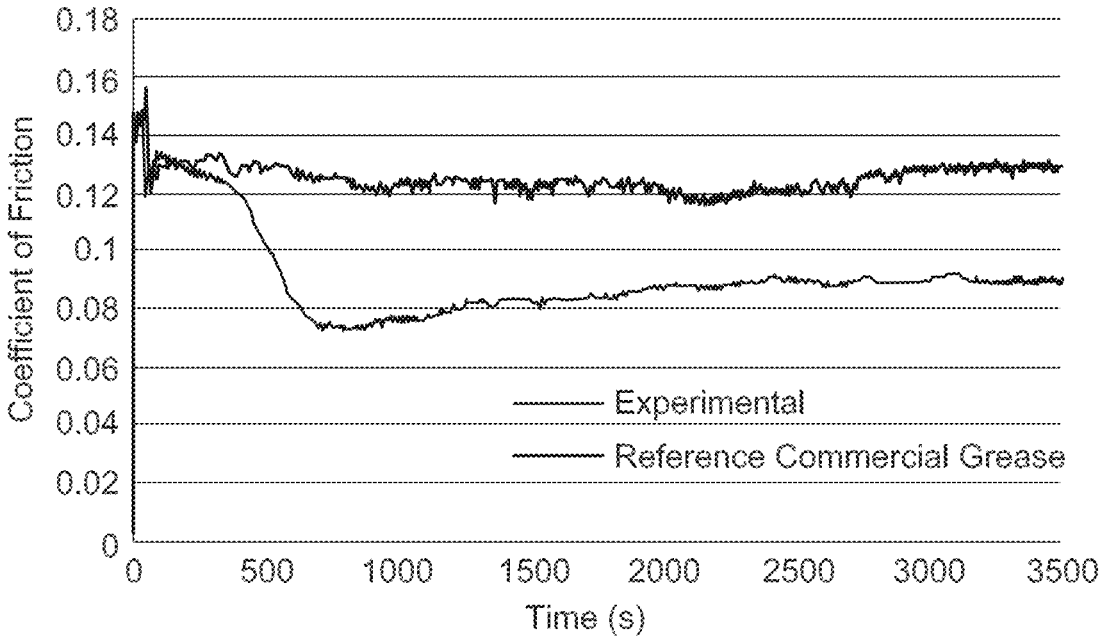
FIG. 3 graphically shows friction trace of a lubricant powder composition of the present disclosure (labeled as Experimental) and a reference standard that is a commercially available grease (Mobilgrease SHC 220, labeled a Reference Commercial Grease) using a standard test method (D5707) for measuring friction and wear properties of lubricant using a high-frequency, linear-oscillation (SRV) test machine.

In addition to probing the physical properties of the lubricant powder compositions, friction and wear characteristics of the powder lubricant was examined using a D5707 SRV wear test. See ASTM D5707-16. FIG. 3 shows a comparison of two lubricant powder compositions: (1) a formulation without thickener (labeled Reference) and (2) a formulation that contains thickener (labeled Experimental). As illustrated in FIG. 3, the reference sample (wax and additives) shows similar friction that is comparable to conventional greases, such as lithium complex grease, with a coefficient of friction of around 0.1, and the experimental sample (containing wax, additives, and the thickener) outperformed the reference sample.

Figure 4:
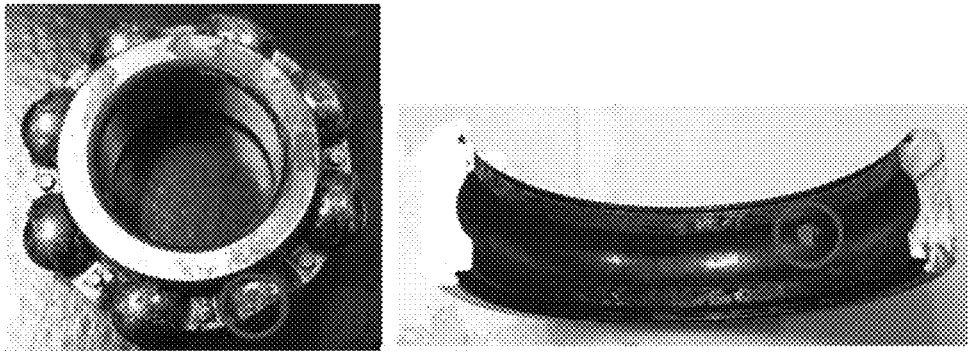
FIG. 4 graphically shows passing results of the lubricant powder composition of the present disclosure from a modified standard test method D1743, static rust test, with only one rust spot. The image on the left shows the bearings that are devoid of rust, except for the spot circled in red. This is not a true rust spot because it is rust transfer from the rust spot on the raceway (image on the right).

In addition to assessing the frictional benefits of the formulation, the wear properties of the formulation was determined by examining the wear scar from the SRV test. FIG. 4 shows the wear volume of the Reference and Experimental formulation from D5707 SRV wear test, displaying a deeper wear scar in Reference sample versus experimental sample. The experimental sample that contains all three components in the formulation outperforms the Reference sample in the reduction of wear on a metal surface.

These results support that the synergies of the components (wax and thickener) within the composition provide the desired performance in the powder as a lubricant. The individual components themselves cannot produce such desired effect.

Comparison with Commercial Grease Lubricants

The lubricant powder compositions show comparative performance as a lubricant when compared to conventional greases. Even further, the lubricant powder compositions have demonstrated benefits over the background technology: e.g. heat reduction, amount of lubricant necessary.

Table 3 shows the comparative results between a conventional lithium complex grease, polyurea grease, and the lubricant powder composition of the present disclosure in the D3336 High temperature ball bearing test for grease, which operates at 350° F. (177° C.) and rotates at 10,000 rpm. See ASTM D3336-18. This is a test that determines the durability of the lubricant. For a conventional lithium complex grease, they can run for around 100 hours on this test. Unexpectedly, the lubricant powder composition of the present disclosure was able to achieve a test duration of over 3 times that of conventional greases.

TABLE 3

Comparison of durability with commercial grease lubricants

| Formulation | Amount of grease or powder in Bearing | Hours of Operation |
|---|---|---|
| Li Complex Grease For example, Mobilgrease 38 | Full Amount | About 100 hr > 36.67 hrs |
| lubricant powder composition of the present invention | <10% of Full Amount | About 330 hr (repeat testing conducted) |
| Mobil Polyrex EM | <10% of Full Amount | About 100 hr |

Table 4 shows the coefficient of friction and wear performance of a lubricant powder composition of the present disclosure (Experimental) and a reference commercially available grease (Reference).

TABLE 4

Comparison of friction properties and wear with other grease lubricants

| | lubricant powder composition of the present invention | Mobilgrease SHC 220 |
|---|---|---|
| Average Coefficient of Friction | 0.09 | 0.13 |
| Average Wear | 0.42 | 0.47 |

These results demonstrated that the lubricant powder composition of the present invention has superior friction and mechanical properties than the commonly used commercial grade grease.

Furthermore, the test for the lubricant powder composition was performed with less than 10%, by weight, of the amount of grease normally loaded into the bearing. One of the benefits of this is the heat reduction due to lower amounts of insulating lubricant in the bearing, which is supported by a slight increase in energy used in the testing apparatus to maintain an elevated temperature for the duration of the test.

Figure 5:
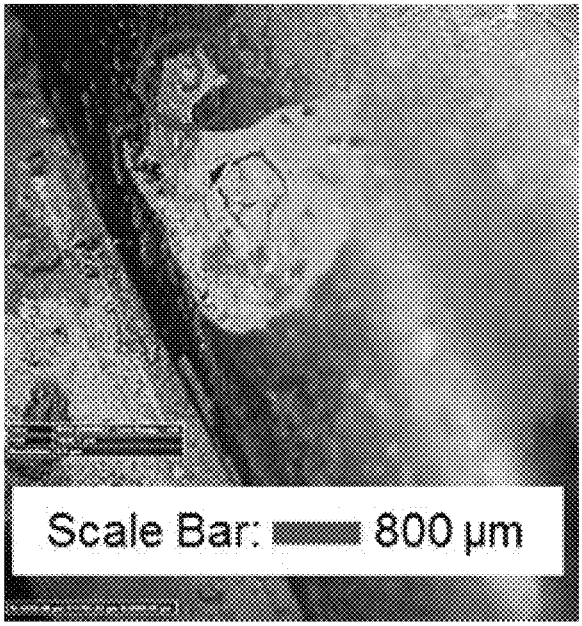
FIG. 5 graphically shows the zoomed in view of the rust spot on the raceway of the bearing (FIG. 5 image on the right). Circled area indicates the spot from which the rust emanated from. This is the only spot of rust found on the bearing from the modified D1743, static rust test.

In addition to the improved durability and lubricity of the lubricant powder composition of the present disclosure, it was shown that lubricant powder composition would also effectively coat the metal surface thus preventing rust. FIGS. 4 and 5 show the results for a modified D1743 (see ASTM D1743-13), static rust test. The modifications to this test was that instead of a tapered roller bearing, an SKF deep groove ball bearing was used. The bearing only showed one spot of rust that was under 1 mm, meaning it has passed the rust test.

Figure 6:
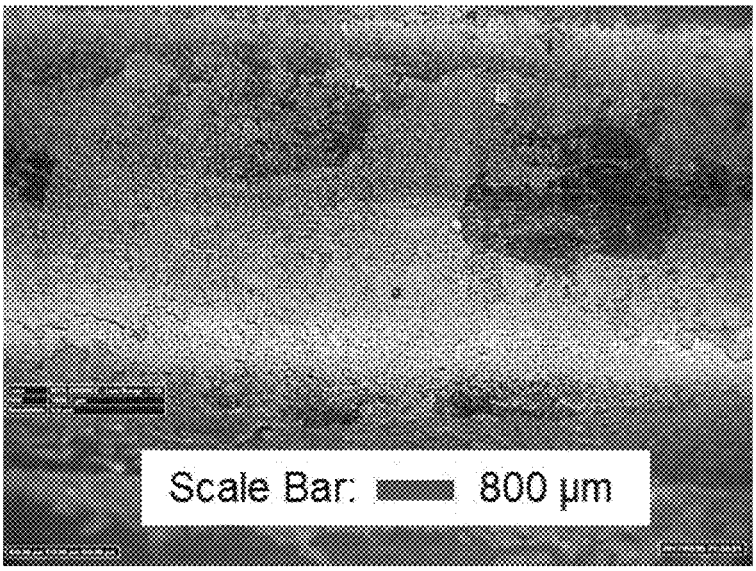
FIG. 6 graphically shows the lubricant powder composition of the present disclosure observed on the raceway of bearing.

To better understand how the powder lubricant performed in the static rust test, a close-up look at the raceway of the bearing from the modified D1743 (FIG. 6). As illustrated in FIG. 6, even with the low loading amount, there is a good distribution of the lubricant material on the raceway. This thin coating prevented rusting on the rollers and the raceway.

As shown in the examples, the lubricant powder composition of this disclosure, which uses wax as a major component, provides unexpected cohesive and adhesive properties that allows the composition to perform as a traditional lubricant or grease would. The lubricant powder composition of this disclosure perform well in high temperature environments and provide a longer application life as well as reduce friction and wear in the metal parts that the composition is lubricating, thereby leading to better energy efficiency and equipment reliability and life.

PCT AND EP CLAUSES

1. A lubricant powder composition comprising: a wax, a grease thickener, and an additive; wherein the wax is in an amount of 50 wt. % or higher in the lubricant powder composition, and the lubricant powder composition is solid at a temperature of 35° C. or at a temperature lower than 35° C.

2. The lubricant powder composition of clause 1, wherein the wax is in an amount of 50 wt. % to 90 wt. %, the grease thickener is in an amount of 5 wt. % to 40 wt. %, the additive is in an amount of 0.1 wt. % to 10 wt. %, in the lubricant powder composition.

3. The lubricant powder composition of clause 1, wherein the wax is in an amount of 60 wt. % to 80 wt. %, the grease thickener is in an amount of 10 wt. % to 30 wt. %, the additive is in an amount of 3 wt. % to 10 wt. %, in the lubricant powder composition.

4. The lubricant powder composition of clauses 1-3, wherein the grease thickener is an organic thickener or an inorganic thickener.

5. The lubricant powder composition of clauses 1-4, wherein the grease thickener is an organic thickener.

6. The lubricant powder composition of clauses 1-5, wherein the wax is a natural wax or a synthetic wax with a melting point of 37° C. or higher.

7. The lubricant powder composition of clauses 1-6, wherein the wax is a paraffin wax.

8. The lubricant powder composition of clauses 1-7, wherein the additive is selected from a group consisting of anticorrosive agent or corrosion inhibitor, an extreme pressure additive, an antiwear agent, a pour point depressants, an antioxidant or oxidation inhibitor, a rust inhibitor, a metal deactivator, a dispersant, a demulsifier, a dye or colorant/chromophoric agent, a seal compatibility agent, a friction modifier, a viscosity modifier/improver, a viscosity index improver, or combinations thereof.

9. A mechanical component lubricated with the lubricant powder composition of clauses 1-8.

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

The invention claimed is:

1. A lubricant powder composition comprising: a wax, a grease thickener, and one or more additives; wherein the wax is in an amount of about 50 wt. % or higher in the lubricant powder composition, and the lubricant powder composition is solid at a temperature of 35° C. or is solid at a temperature lower than 35° C., wherein the grease thickener is a soap thickener or a polyurea thickener.

2. The lubricant powder composition according to claim 1, wherein the grease thickener is an organic thickener.

3. The lubricant powder composition according to claim 1, wherein the wax is in an amount of about 50 wt. % to about 90 wt. %, the grease thickener is in an amount of about 1 wt. % to about 40 wt. %, the additive is in an amount of about 0.1 wt. % to about 32 wt. %, in the lubricant powder composition.

4. The lubricant powder composition according to claim 3, wherein the wax is a natural wax.

5. The lubricant powder composition according to claim 3, wherein the wax is a paraffin wax.

6. The lubricant powder composition according to claim 3, wherein the additive is selected from a group consisting of anticorrosive agent or corrosion inhibitor, an extreme pressure additive, an antiwear agent, a pour point depressants, an antioxidant or oxidation inhibitor, a rust inhibitor, a metal deactivator, a dispersant, a demulsifier, a dye or colorant/chromophoric agent, a seal compatibility agent, a friction modifier, a viscosity modifier/improver, a viscosity index improver, or combinations thereof.

7. The lubricant powder composition according to claim 1, wherein the wax is in an amount of about 60 wt. % to about 80 wt. %, the organic thickener is in an amount of about 10 wt. % to about 30 wt. %, the additive is in an amount of about 3 wt. % to about 20 wt. %, in the lubricant powder composition.

8. The lubricant powder composition according to claim 7, wherein the wax is a natural wax.

9. The lubricant powder composition according to claim 7, wherein the wax is a paraffin wax.

10. The lubricant powder composition according to claim 7, wherein the additive is selected from a group consisting of anticorrosive agent or corrosion inhibitor, an extreme pressure additive, an antiwear agent, a pour point depressants, an antioxidant or oxidation inhibitor, a rust inhibitor, a metal deactivator, a dispersant, a demulsifier, a dye or colorant/chromophoric agent, a seal compatibility agent, a friction modifier, a viscosity modifier/improver, a viscosity index improver, or combinations thereof.

11. A mechanical component lubricated with the lubricant powder composition according to claim 1.

12. The lubricant powder composition according to claim 3, wherein the wax is a synthetic wax.

13. The lubricant powder composition according to claim 7, wherein the wax a synthetic wax.

14. The lubricant powder composition according to claim 1, wherein the grease thickener is a polyurea thickener.

* * * * *